US009867436B2

(12) United States Patent
Lenhart et al.

(10) Patent No.: US 9,867,436 B2
(45) Date of Patent: Jan. 16, 2018

(54) POLE GRIP HAVING A GUIDED LOOP

(71) Applicant: LEKISPORT AG, Baar (CH)

(72) Inventors: Klaus Lenhart, Ohmden (DE); Eberhard Heim, Unterensingen (DE); Wladimir Kreis, Kirchheim (DE)

(73) Assignee: LEKISPORT AG, Baar (CH)

( * ) Notice: Subject to any disclaimer, the term of this patent is extended or adjusted under 35 U.S.C. 154(b) by 62 days.

(21) Appl. No.: 14/397,926

(22) PCT Filed: Apr. 18, 2013

(86) PCT No.: PCT/EP2013/058040
§ 371 (c)(1),
(2) Date: Oct. 30, 2014

(87) PCT Pub. No.: WO2013/171016
PCT Pub. Date: Nov. 21, 2013

(65) Prior Publication Data

US 2015/0150344 A1 Jun. 4, 2015

(30) Foreign Application Priority Data

May 18, 2012 (CH) ..... 703/12

(51) Int. Cl.
*A45B 9/02* (2006.01)
*A63C 11/22* (2006.01)

(52) U.S. Cl.
CPC ..... *A45B 9/02* (2013.01); *A63C 11/222* (2013.01); *A45B 2009/025* (2013.01); *Y10T 16/466* (2015.01)

(58) Field of Classification Search
CPC ... A45B 9/02; A45B 2009/025; A63C 11/222; A41D 19/0037; Y10T 16/466; Y10T 74/20834

(Continued)

(56) References Cited

U.S. PATENT DOCUMENTS 5,110,154 A * 5/1992 Street ..... A41D 19/0037 135/72
5,312,134 A * 5/1994 Goode ..... A41D 19/0037 2/160

(Continued)

FOREIGN PATENT DOCUMENTS

DE 197 51 978 C2 7/2001
WO 95/13848 A 5/1995

(Continued)

OTHER PUBLICATIONS

International Preliminary Report on Patentability dated Nov. 27, 2014 from the International Searching Authority in counterpart application No. PCT/EP2013/058040.

(Continued)

*Primary Examiner* — William Miller
(74) *Attorney, Agent, or Firm* — Sughrue Mion, PLLC

(57) ABSTRACT

A pole grip for walking sticks, trekking poles, alpine ski, cross-country ski, or Nordic walking poles, and an associated hand-retaining device, or a set of said elements. The pole grip has a grip body and a hook-like device for fastening the hand-retaining device. Movable or rotatable locking elements are arranged in the area of the hook-like device in such a way that a loop-shaped device provided on the hand-retaining device and inserted into the hook-like device substantially from above is fastened in the hook-like device in a self-locking manner. The design is characterized in that elements that prevent rotation of a loop-shaped device fastened to the hook-like device about the longitudinal axis of the hook-like device by elements of form closure are provided on the hook-like device, and that corresponding complementary elements are provided on the hand-retaining device.

25 Claims, 5 Drawing Sheets

(58) Field of Classification Search
USPC ..... 2/160, 161.1; 16/421; 74/551.9; 280/821, 822; 135/72
See application file for complete search history.

(56) References Cited

U.S. PATENT DOCUMENTS 5,328,205 A * 7/1994 Bacharach ..... A63C 11/222 135/72
5,443,287 A * 8/1995 Wells ..... A63C 11/222 280/822
5,470,108 A * 11/1995 Goode ..... A63C 11/222 135/75
5,516,150 A 5/1996 Goode et al.
5,887,282 A 3/1999 Lenhart
6,264,242 B1 * 7/2001 Lenhart ..... A45B 9/02 280/821
6,325,418 B1 * 12/2001 Lenhart ..... A63C 11/222 280/821
7,621,564 B2 * 11/2009 Lenhart ..... A45B 9/02 280/819
7,665,769 B2 * 2/2010 Lenhart ..... A63C 11/222 135/76
7,690,085 B2 * 4/2010 Lenhart ..... A63C 11/222 16/436
7,770,931 B2 * 8/2010 Lenhart ..... A45B 9/02 280/821
8,079,617 B2 * 12/2011 Lenhart ..... A45B 9/02 135/72
8,579,329 B2 * 11/2013 Lenhart ..... A63C 11/222 280/821
8,714,172 B2 * 5/2014 Heim ..... A45B 9/02 135/65
2008/0005826 A1 * 1/2008 Lenhart ..... A63C 11/222 2/160
2012/0061371 A1 * 3/2012 Broom ..... A63C 11/228 219/211
2016/0136507 A1 * 5/2016 Bennert ..... A63C 11/228 280/822

FOREIGN PATENT DOCUMENTS

WO 2006/066423 A1 6/2006
WO 2006/066424 A1 6/2006

OTHER PUBLICATIONS

International Search Report for PCT/EP2013/058040 dated May 14, 2013.
Written Opinion for PCT/EP2013/058040 dated May 14, 2013.

* cited by examiner

A–A

POLE GRIP HAVING A GUIDED LOOP

CROSS REFERENCE TO RELATED APPLICATIONS

This application is a National Stage of International Application No. PCT/EP2013/058040 filed Apr. 18, 2013, claiming priority based on Swiss Patent Application No. 00703/12 filed May 18, 2012, the contents of all of which are incorporated herein by reference in their entirety.

TECHNICAL FIELD

The present invention relates to a pole grip, in particular for walking sticks, trekking poles, alpine ski poles, cross-country ski poles and Nordic walking poles. The pole grip has a grip body with a hook-like device for fastening a hand-retaining device in particular in the form of a hand loop or a glove. The invention further relates to a hand-retaining device, which cooperates optimally with such a pole grip.

PRIOR ART

In such a device which is known, for example, from U.S. Pat. No. 5,516,150, a hook is provided on the pole grip and a rigid and clip-shaped device formed from a metal bend is provided on the appurtenant glove in the region between thumb and forefinger. The clip is inserted with its long leg into a narrow slot of the hook and by means of the hook-like device the clip and therefore the glove are fixed on the pole grip.

At the same time, a slight expansion of the slot is provided in the hook at the bottom, which has the result that during insertion into the hook the clip initially presses the two legs of the hook slightly apart and the legs only return into the original position when the clip has been pushed into the expansion.

An elastic deformation of the hook-like device is thus used to ensure a light fixing of the clip in the hook and to avoid a simple slipping of the clip out from the hook.

A problem with such devices is inter alia the fact that repeated deformations of such components, which are usually formed from plastic or metal, are undesirable as a result fatigue effects.

Furthermore, the problem arises in particular that the elastic deformation behaviour of materials is highly temperature-dependent. Consequently, the fixing effect which is obtained due to the deformation is neither adjustable nor constant for different temperatures.

This is in particular absolutely unacceptable in the sports area, since very large temperature differences on the one hand due to different weather conditions and on the other hand due to heating during use, are unavoidable.

Known from WO 2006/066423 is a pole grip having a grip body and having a hook-like device for fastening a hand-retaining device, in particular in the form of a hand loop or a glove. In this case, latching means are disposed in the region of the hook-like device in such a manner that a loop-shaped, ring-shaped or eyelet-shaped device, which is inserted from above into the hook-like device and which is provided on the hand-retaining device, is fixed in the hook-like device in a self-latching fashion, in the manner of a latching mandrel. This self-latching mechanism simplifies the handling and can be combined with a safety release in the event of a heavy load acting in the opening direction of the hook-like device. However, it proves to be problematical that the loop-shaped, ring-shaped or eyelet-shaped device can be twisted about the latching mandrel and the direction control in use can thereby be negatively influenced. A corresponding hand-retaining device suitable for such a pole grip is known from WO 2006/066424.

DESCRIPTION OF THE INVENTION

This is where the present invention intervenes and solves the problems of the prior art by a pole grip according to claim 1 or an appurtenant hand loop or an appurtenant glove according to claim 9 or a combination of these two elements according to claim 14.

Specifically the invention relates to a pole grip, in particular for walking sticks, trekking poles, alpine ski poles, cross-country ski poles and Nordic walking poles comprising a grip body and comprising a hook-like device for fastening a hand-retaining device, in particular in the form of a hand loop or a glove, wherein displaceable or twistable latching means are arranged in the area of the hook-like device in such a manner that a loop-shaped, ring-shaped or eyelet-shaped device inserted into the hook-like device (latching mandrel) substantially from above, which is provided on the hand-retaining device, is fixed in the hook-like device in a self-latching manner. The problem of the twistability of the device about the hook-like device is solved whereby means are provided on the hook-like device which prevent any twisting of a loop-shaped, ring-shaped or eyelet-shaped device fastened on the hook-like device about the longitudinal axis of the hook-like device by means of form closure. This specifically involves an improvement in a design as is known from WO 2006/066423 and accordingly the disclosure content of this application is expressly included in the disclosure content of the present application.

According to a first preferred embodiment, these means can be configured in the form of a groove in the hook-like device extending along the longitudinal axis, which then interacts with a corresponding rib on the hand-retaining device by means of form closure.

Alternatively or however also additionally and according to a second preferred embodiment, these means can comprise means in the form of a rib on the hook-like device extending along the longitudinal axis, which then interacts with a corresponding groove in the hand-retaining device by means of form closure.

According to a further preferred embodiment, such a pole grip is characterized in that the means are configured in the form of a groove in the hook-like device extending along the longitudinal axis and that the groove is provided in the rear surface of the hook-like device facing away from the grip body and extends from the upper-side tip of the hook-like device, where the groove is configured to be open, downwards over the entire length of the hook-like device and is closed at the lower end by a groove boundary.

The groove above that region in which a loop-shaped, ring-shaped or eyelet-shaped device inserted into the hook-like device is captured in a slot between the hook-like device and the grip head is here not only important for the insertion phase but also during use. If a corresponding rib is specifically provided on the hand-retaining device as preferably above the device, during a pivoting movement of the grip from the hand this engages in this groove and also stabilizes positively in this pivoting phase before any twisting of hand loop relative to the pole grip. Thus, a stabilization is ensured over the entire movement range within the framework of the prescribed use.

At the same time, according to a further preferred embodiment, this groove boundary is disposed in relation to the grip head below that region in which a loop-shaped, ring-shaped or eyelet-shaped device inserted into the hook-like device is captured in a slot between the hook-like device and the grip head. This means that the loop-shaped, ring-shaped or eyelet-shaped device is inserted, the corresponding stabilization is also ensured below this device which is particularly important when the hand grips the pole grip.

A further preferred embodiment is characterized in that the groove over its length has a substantially constant width b transverse to the longitudinal axis of the hook-like device and at the upper end preferably has a region which expands upwards.

A further preferred embodiment is characterized in that the groove has a recess, preferably in the form of a circular or polygonal blind hole, in the region of the groove boundary in the groove base. This recess is preferably disposed below that region in which a loop-shaped, ring-shaped or eyelet-shaped device inserted into the hook-like device is captured in a slot between the hook-like device and the grip head and is used for particularly good stabilization in that phase where the hand grips the pole grip. For this purpose a specific guide pin is then provided on the hand-retaining device below the device, as will be explained in further detail below.

Further preferably, the groove can be configured as a U-shaped groove with flanks standing parallel to one another and groove base disposed perpendicular thereto, or with flanks converging slightly towards the groove base, wherein preferably the depth t of the groove as far as the groove base is in the region of 0.5-4 mm, particularly preferably in the range of 0.75-1.5 mm.

The width b of the groove is preferably in the range of 0.1-0.75 times the width B of the hook-like device at its half height between tip and region for loop-shaped, ring-shaped or eyelet-shaped device inserted in the hook-like device, wherein preferably the width b corresponds to 0.25-0.5 times this width B of the hook-like device. Particularly preferably the width b lies in the range of 0.2-0.7 cm, quite particularly preferably in the range of 0.3-0.7 cm.

The length of the hook-like device measured from the tip thereof facing the grip head as far as the region in which a loop-shaped, ring-shaped or eyelet-shaped device inserted in the hook-like device is captured in a slot between the hook-like device and the grip head lies further preferably in the range of 2-4.5 cm, particularly preferably in the range of 3-4 cm.

Further preferably, the width B of the hook-like device lies in the range of 1-1.5 cm and particularly preferably tapers towards the tip over a length of 1.5-2 cm in rounded form.

In addition, the cross-sectional surface of the hook-like device is preferably configured to be oval or lens-shaped with the long axis transverse to the pole grip and to the prescribed running direction, wherein the short axis except in the tip-side tapering region has a length in the range of 0.3-1.5 cm, preferably in the range of 0.5-1 cm.

As already mentioned, the present invention additionally relates to a corresponding hand-retaining device, in the sense of key/lock for the afore-mentioned pole grip, in particular in the form of a glove or a hand loop for use with a pole grip as described above. Such a hand-retaining device is particularly preferably characterized in that in the region between thumb and forefinger, a loop-shaped, ring-shaped or eyelet-shaped device which is inherently flexible but nevertheless positionally stable in space is provided. In this respect this therefore comprises an improvement of a hand-retaining device as is already known from WO 2006/066424 and accordingly the disclosure content of this application is expressly included in this disclosure content in the present case.

The new proposed hand-retaining device here additionally has means provided substantially parallel to the opening axis of the device above and/or below the device, which means prevent any twisting of the loop-shaped, ring-shaped or eyelet-shaped device fastened on the hook-like device about the longitudinal axis of the hook-like device by means of form closure by engaging in the groove in the hook-like latching device.

Particularly preferably the loop-shaped, ring-shaped or eyelet-shaped device which is inherently flexible but nevertheless positionally stable in space comprises a loop of a flexible material which has sufficient intrinsic stiffness so that it is stabilized in a position in the space between thumb and forefinger which enables a simple insertion via the hook or retaining mandrel and which on the other hand is not perceptible or barely perceptible in use. Loops of multifilament mesh, cable or wire which can optionally be coated on the surface, for example, are possible. In principle, other elements are suitable as material for such loops such as, for example low-elongation and tension-stable textile fibres encased in a fabric tube or cord or cable-like braided retaining elements using corresponding low-elongation plastic materials such as, for example, aramid, polyethylene, in particular highly stretched UHMWPE such as Dyneema etc. When using such materials for the loop, cords having a thickness of 1-5 mm are most suitable, with a thickness of 2-3 mm being preferable. In order to give the loop sufficient intrinsic stiffness, such cords can be provided with stiffening elements such as, for example, a "core" of monofilament nylon or woven fibres of stiffer materials such as, for example, Nylon or thin metal wires. It is shown that a cable having a thickness in the range of 0.5-2.5 mm, preferably in the range of 1-2 mm is particularly suitable.

The, for example, braided or twist-laid cable can be coated with a different material such as, for example, plastic. Alternatively it is possible to make the loop from a plastic material, also for example, strip-shaped, preferably from a fibre-reinforced plastic, for example, polyamide, PE, PP or similar are suitable, where combined materials with a layer structure are possible and particularly preferably reinforcements with fibres, for example, made of aramid, can be provided.

The loop preferably protrudes between 5-20 mm, in particular between 5-10 mm beyond the saddle region between forefinger and thumb. In this case, the direction of the loop is to a certain extent substantially the angle bisector between the direction of thumb and forefinger.

It is possible to configure the loop to be adjustable, where this adjustability is provided on the one hand to specifically adjust the length to the user or however, also when the loop is not required, to withdraw this so that it is no longer perceptible during use. It is also possible to stow the loop, when not being used, in a small pocket provided between forefinger and thumb in the saddle region, which is provided in the hand-retaining device. The latter possibility is constructively particularly simple and in view of the intrinsic stiffness of the loop, the loop can be accommodated in such a pocket on the one hand and on the other hand remains provided substantially without special measures in the pocket during use of the hand-retaining device when not specially manipulated.

In order to ensure the best possible coupling of the forces acting on the loop to the hand-retaining device, the wire/the cable of the loop can at least partially be guided in or on the hand-retaining device in the direction of the wrist. It is also possible to make a combination with an adjustable device as described in DE 19751978 C2 whose disclosure in this regard is expressly included. Instead of the rigid connecting element mentioned in this document, simply a flexible loop is provided. The loop is in particular substantially less disturbing when using the glove without interaction with the pole.

Preferably, the hand-retaining device according to a first embodiment is therefore characterized in that the loop consists of a flexible plastic cord having intrinsic stiffness. Preferably the loop here is fastened substantially immovably on the hand-retaining device but the loop per se is configured to be movable.

As already mentioned, the hand-retaining device can comprise a glove or however also a hand loop which has three openings and which can be fastened to the hand particularly preferably with the aid of a hook and loop fastener, where a first opening is provided for the thumb, a second opening is provided for the other fingers or the back of the hand and a third opening of the hand loop for the wrist.

According to a preferred embodiment, such a hand-retaining device is now characterized in that the means are configured in the form of a groove extending along the opening axis in the hand-retaining device for positive interaction with the pole grip during use. This then interacts with a corresponding rib or projections in or on the pole grip.

Alternatively or additionally, this means can also be configured in the form of a rib extending along the opening axis and/or in the form of at least one projection disposed on this axis. These then interact with a corresponding groove or recess in the hook-like device of the pole grip.

A further preferred embodiment is characterized in that the means are configured in the form of a rib extending along the opening axis on a region of the hand-retaining device facing the pole grip when used as prescribed.

The rib is preferably provided at least on the side disposed above the device when used as prescribed, wherein the rib preferably has a length of 5-25 mm, particularly preferably in the range of 10-15 mm and a width preferably in the range of 0.2-0.7 cm, particularly preferably in the range of 0.3-0.7 cm.

According to a preferred embodiment, such a rib can be formed from a thermoplastic material and with a substantially rectangular or square cross-sectional area, EPDM, TPU, TPE. From the production technology viewpoint and also with regard to stability and durability, such a construction is particularly suited when an attachment made of such a thermoplastic material is provided which has a wide base region and the said rib is formed thereon, typically in one piece. Likewise, a guide pin can be disposed on this base region and this entire unit can accordingly then be fastened on a textile material of the hand loop, whether by gluing and/or by sewing or both. Moulding on is also possible. If the rib is arranged above the device and the guide pin below, between these two elements the base region can be formed by a narrow web which connects rib and guide pin and runs through the region of the device. It is also possible that the guide pin is formed as a separate screw or rivet which is screwed or riveted through the loop strip or welded to the back.

Alternatively, the rib can be provided by a sewn-in, welded-in or glued-in shaped piece. This is sewn in, welded in or glued in so that it forms an elongated rib running between thumb and forefinger and projecting towards the hand grip. In other words, according to a further preferred embodiment, the rib can be formed by a flat material strip which includes an elongated shaped piece extending along the opening axis, which produces the rib curvature. In this design, the rib preferably extends from below the eyelet to above and through this. The shaped piece can either be provided by means of a separate material strip which is sewn on, glued on or welded on and encloses the shaped piece but the shaped piece can also be provided in a multilayer design of the hand loop in this region between thumb and forefinger without separate additional material strips. The material strip preferably comprises a woven or felt-like textile strip, a plastic strip or a leather strip or a strip of a combination of such materials. Typically when the material strip is configured as a separate sewn-on element, it is longer than the shaped piece and the latter is preferably enclosed with a preferably circumferential seam, gluing and/or welding.

The shaped piece can be formed from one or more monofilament or multifilament pieces of cord or from plastic or metal. Said shaped piece preferably has a round, oval or polygonal cross-section and a diameter in the range of 1-6 mm, preferably in the range of 1.5-4 mm. In order not to disturb between thumb and forefinger during use and to adapt to the shape of the hand during use, the shaped piece is bendable about its longitudinal axis but provides the desired substantially non-elastic base for the rib perpendicular to the longitudinal axis.

Such a hand-retaining device can further preferably be characterized in that the means additionally comprise a guide pin preferably having a substantially circular cross-sectional area, which guide pin is preferably disposed below the device when used as prescribed and which has a height which is preferably greater than the height of the rib. Preferably no means are provided at the height of the device (apart from optionally a web for connecting rib disposed above and guide pin disposed below as mentioned above) but only when used as prescribed above and preferably additionally below.

The present invention further relates to a pole grip set comprising a pole grip as described and a hand-retaining device as described, characterized in that the means on the pole grip and the means on the hand-retaining device are matched to one another in regard to dimensioning so they positively intermesh when the hand-retaining device is fastened on the pole grip.

Such a pole grip set is preferably characterized in that the means are configured in such a manner that during the prescribed pivoting movement of the hand-retaining device about the pole grip they intermesh positively above the loop-shaped, ring-shaped or eyelet-shaped device in the hook-like device. Further embodiments are specified in the dependent claims.

BRIEF DESCRIPTION OF THE DRAWINGS

Preferred embodiments of the invention are described hereinafter with reference to the drawings which merely serve for explanation and should not be interpreted as restrictive. In the drawings.

DESCRIPTION OF PREFERRED EMBODIMENTS

Figure 1:
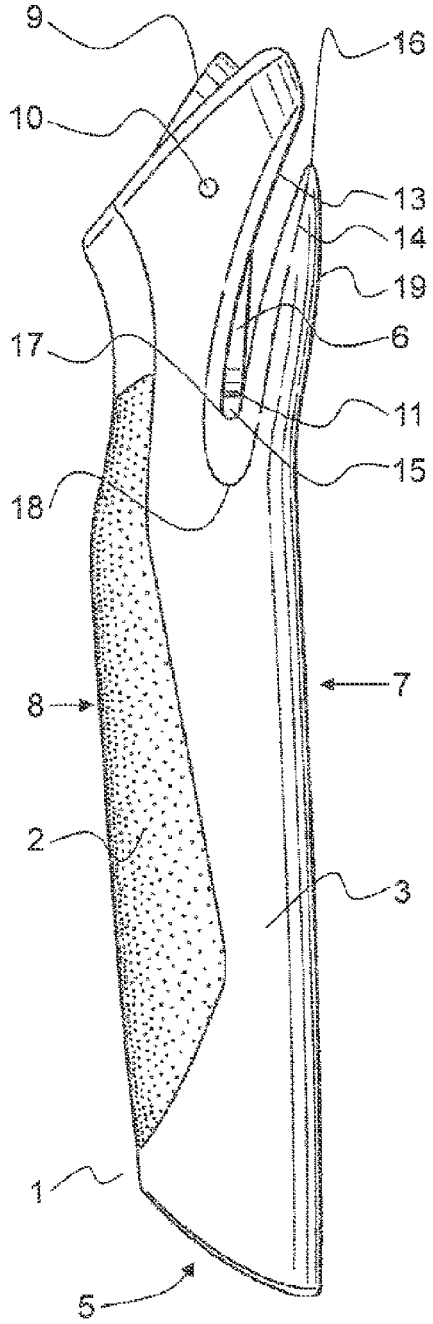
FIG. 1 shows a side view of a first exemplary embodiment.

FIGS. 1-7 show a first exemplary embodiment of a pole grip with a hand loop. The pole grip 1 is here configured as a Nordic walking cross country ski pole grip and has an elongated structure with a grip body 3 and a soft grip region 2 on the front side 8, which for example can be made from a softer material in a two-component injection moulding method together with the grip body made of a harder material or can be let into a recess in the grip body 3 in a subsequent fabrication step. The grip body has a recess 5 for a pole tube (not shown in the figures) on the underside and typically a pole tip is arranged at the lower end of this pole tube. On the hand side 7, in the region of the grip head, that is at the top, the grip has a slot 13 extending at an acute angle to the grip axis, so that a hook-like device 14 in the form of a retaining mandrel is formed offset from the pole grip. The tip 16 of this retaining mandrel is disposed somewhat below the highest point of the pole grip.

In the pole grip there is a recess accessible from above in which a block is arranged rotatably about an axis of rotation 10 in a spring-mounted pre-tensioned manner and which can be actuated by means of the actuating button 9. This block 6 comprises an extension passing through an opening to the slot 13 and in particular forms a retaining lug 11. In the diagram according to FIG. 1 the fixing block is tensioned by a spring against the retaining mandrel 14, that is if the actuating button 9 is not pressed down, the retaining lug 11 is pressed on the inner side so that it abuts against the retaining mandrel 14 due to this spring tension.

Below the retaining lug 11 there is a free region 15 whose lowest saddle point 17 defines the lowest position of a loop 26 inserted into this slot 13. Located somewhat deeper than this saddle point 17 on both sides of the pole grip is a lower transition region 18 which defines the transition to the outer surface of the grip body 3.

Figure 3:
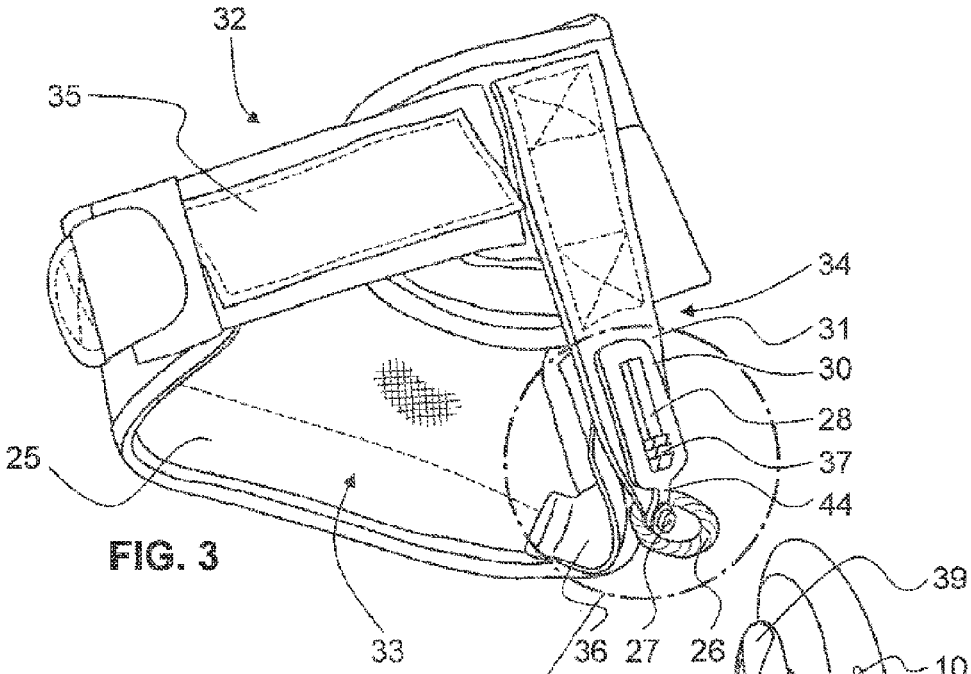
FIG. 3 shows a perspective view of a hand loop.
Figure 4:
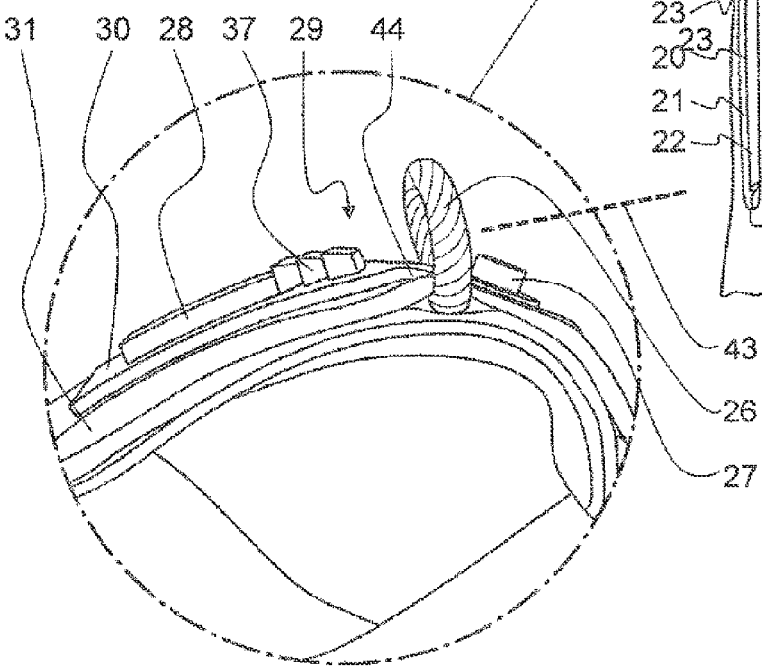
FIG. 4 shows an enlarged section from FIG. 3.
Figure 5:
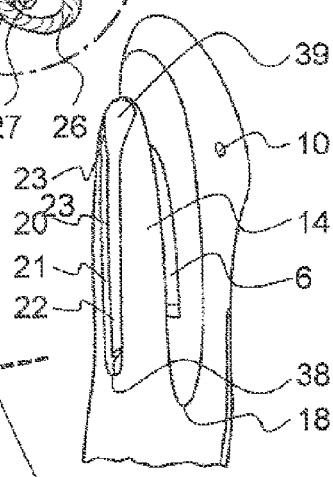
FIG. 5 shows a perspective view of the head region of the grip according to the first exemplary embodiment.

A hand-retaining device as shown for example in FIGS. 3 and 4 can be fastened to such a pole grip by pushing the loop 26 of the hand-retaining device over the retaining mandrel 14, then urges the fixing block in a self-engaging manner against the spring force into the pole grip until the loop has reached the region 15, the block then recoils back into the rest position shown in FIG. 1 and then the loop is captured there in this region 15. Typically the loop 26 is specifically adjusted so that it embraces the retaining mandrel 14 abutting tautly under a certain tension, as shown for example in FIGS. 6 and 7.

Figure 2:
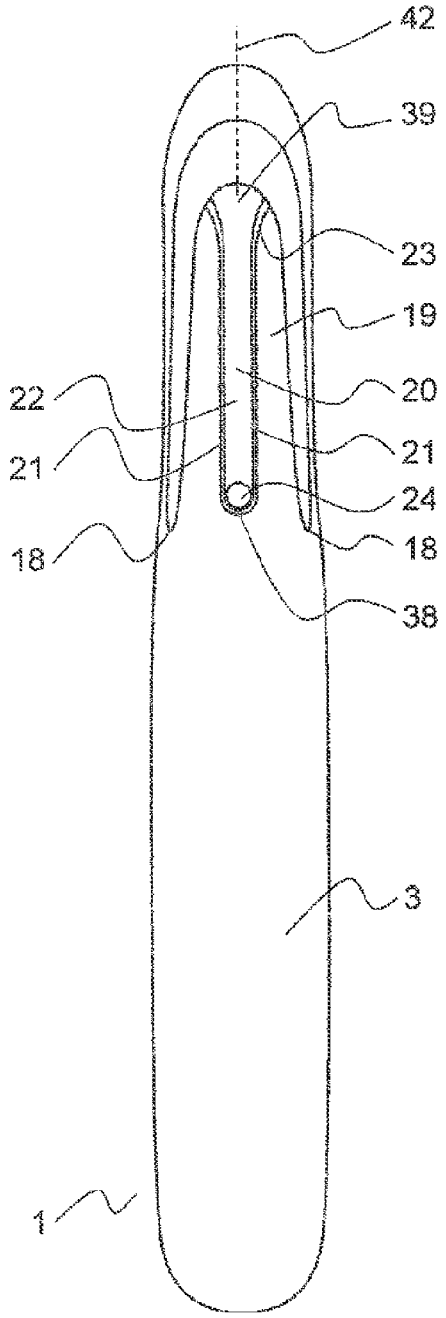
FIG. 2 shows a view of the first exemplary embodiment from behind.

It is now important that on the hand side 7, that is in particular on the back, which can be identified in particular in the corresponding view in FIG. 2, a longitudinal groove 20 extending along the longitudinal axis 42 of the pole grip or the retaining mandrel is disposed in the surface 19 of the retaining mandrel, which groove is configured to be open at the top, that is in the region of the tip 16 of the retaining mandrel, whereas it is closed at the lower end by a groove boundary 38. The groove 20 has two lateral flanks 21 and a groove base 20 disposed perpendicular to these two flanks. In a sectional view the groove is preferably a U-profile having two parallel flanks 21 or side walls of the groove, but the two side walls can be made to be slightly expanding with respect to one another, that is slightly converging towards the groove base.

To facilitate insertion of the hand-retaining device, this groove expands towards the tip 16 in an upper-side expansion region 23 in a trumpet shape. On the lower side the groove boundary 38 is configured to be rounded. The groove boundary runs substantially over the entire length of the groove at the same height, in the region of the lowest section, that is specifically adjoining the groove boundary 38, but in this case a blind-hole like recess 24 is provided, that is in this region the depth of the groove on a circular surface is somewhat deeper than in the region located above. The function of this recess is explained in detail further below.

FIGS. 3 and 4 show a hand loop for cooperative complementary interaction with such a pole grip construction. This comprises a hand loop with three openings, one opening as insertion opening for the hand, one outlet opening 33 for the back of the hand and finger and one opening 34 for the thumb. The hand loop here has an adjusting mechanism, for example, in the form of a textile strip guided through a hook and loop fastener and through a metal loop, which can be opened for adjustment and which can be variably adjusted in length and which can be fixed by the hook and loop fastener.

Such a hand loop 25 now has in the region between thumb and forefinger, that is in the corresponding saddle region of the hand, on the one hand a textile or leather section 36 on the inner side as a protective covering and above this, a textile strip which is given the reference number 31. Sewn into this textile strip is a loop 26 which, as already described above is used for fastening the hand-retaining device on the pole grip. This loop 26 is typically a braided loop made of a highly tensile-resistant material such as, for example, Dyneema which certainly has a certain flexibility and therefore does not disturb between thumb and forefinger but nevertheless has a sufficient intrinsic stability so that it can be simply pulled over the retaining mandrel 14 without needing to be manipulated in its position. For this purpose this loop is quite specifically sewn into the optimal position on the textile strip 31 and a second textile strip possibly located therebelow.

A plastic attachment 30 made of a thermoplastic material is now provided in addition to this loop, this being important for cooperation with the pole grip already described above. This is glued on, moulded on and/or sewn on the textile layer 31 and on its outer side has an elongated rib 28 which has a width which corresponds to the width of the groove 20 of the pole grip or specifically is configured to be somewhat narrower. The rib additionally has a depth which is also adapted to the depth of the groove 20 or specifically is configured to be somewhat smaller. When used as prescribed the rib 28 is disposed above the loop 26 and in the near region additionally optionally has wedge-shaped expansions in the form of sawtooth-shaped elevations 37.

A guide pin 27 is disposed on the other lower side of the loop 26. This guide pin 27 has a greater height than the rib 28 and is, for example, also formed from the thermoplastic material of the attachment 30 but can also consist of metal such as, for example, aluminium and is connected to the region of the attachment 30 where the rib 28 is disposed via an optional narrow web 44. This narrow web therefore connects the region of the guide pin 27 and that of the rib 28 and runs through the loop 26. This web enables the means for positive guidance of the hand-retaining device on the pole grip construction to be formed in one piece, which is advantageous both with regard to stability and also with regard to production processes.

Figure 6:
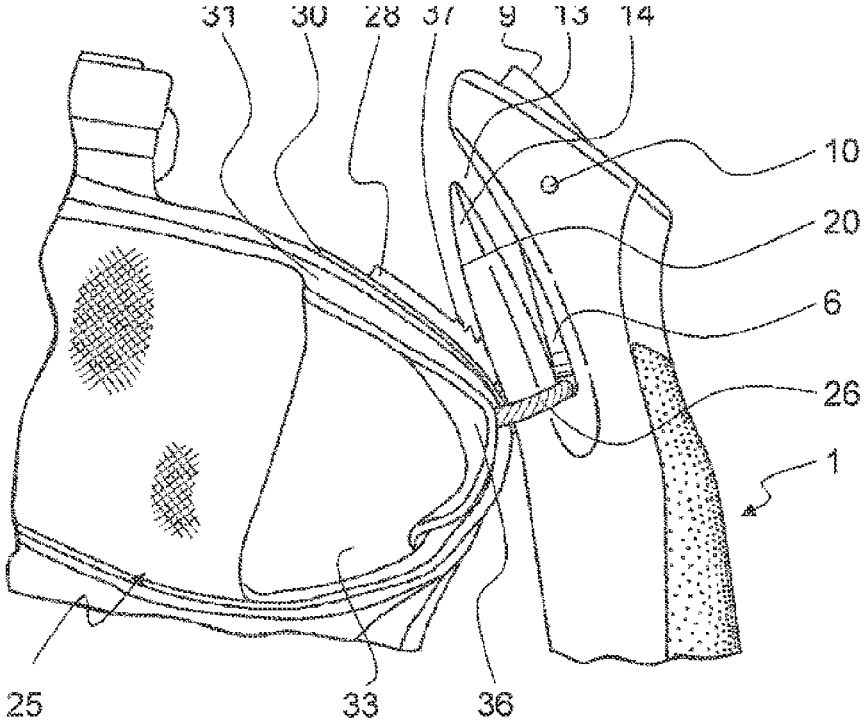
FIG. 6 shows a pole grip according to the first exemplary embodiment with hand loop fastened in the lower position.
Figure 7:
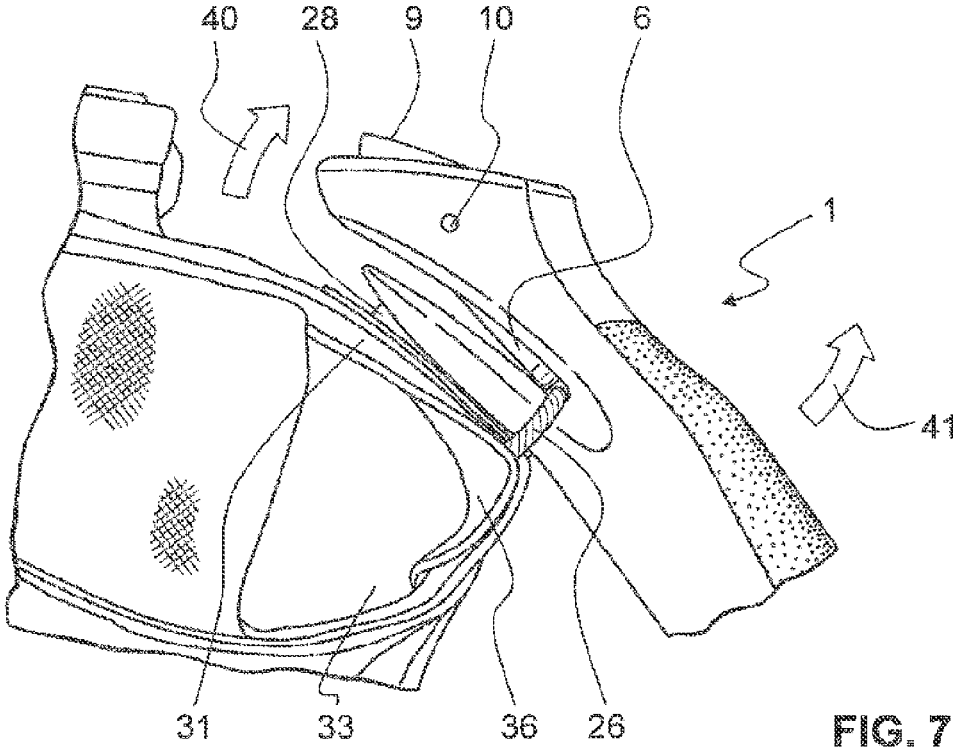
FIG. 7 shows a pole grip according to the first exemplary embodiment with hand loop fastened in the upper position.
Figure 8:
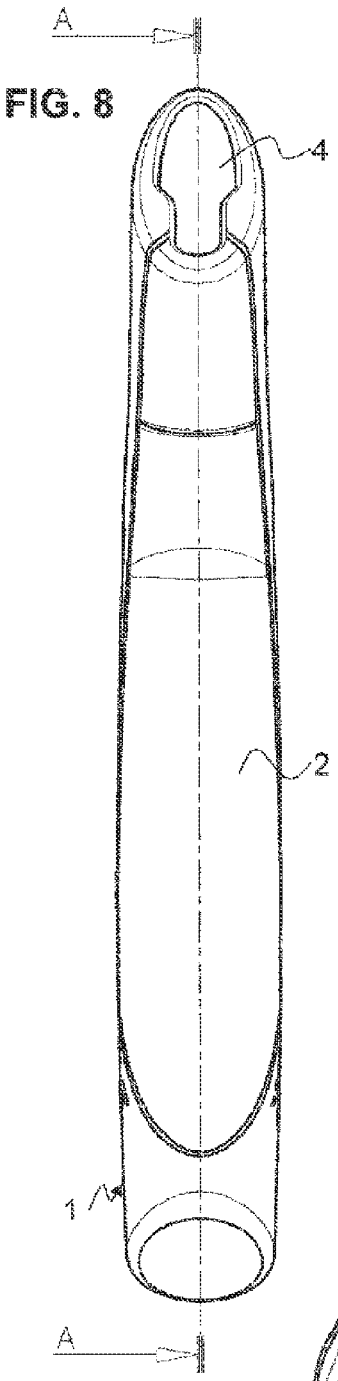
FIG. 8 shows a view from the front of a grip according to a second exemplary embodiment.

The advantages of rib 28 and pin 27 can be seen from FIGS. 6 and 7. FIG. 6 shows the lower position of the hand-retaining device on the pole grip approximately in that position when the hand embraces the pole grip. In this position the guide pin 27 is in deep engagement with the groove 20 in the pole grip and in particular engages in the recess 24 specifically provided for this. In addition, above the loop 26 the rib 28 engages in the groove 20. In the lower position of the hand loop as shown in FIG. 6 it is thus ensured that the loop 26 cannot twist around the retaining mandrel 14.

In order to now ensure this positive securing of the rotational position of the loop 26 around the retaining mandrel, even when the pole grip tilts during a sporting running movement, the rib 28 is now configured over a considerable length towards the top and when the hand-retaining device is moved relative to the pole grip along the arrows specified in FIG. 7 for the pendulum movement 40/41, the rib 28 engages positively in the upper region of the groove 20 and stabilizes not only the loop 26 before twisting but the entire hand-retaining device is now also stabilized in the upper region in the ideal movement position. This upper region of the rib 28 in its positive interaction with the groove 20 in other words serves not only to ensure a twisting of the loop 26 around the retaining mandrel even when the guide pin 27, for example, should no longer be in engagement with the groove but also serves to ensure a controlled rolling position of the hand loop for this pivoting position over the entire rolling region.

Figure 9:
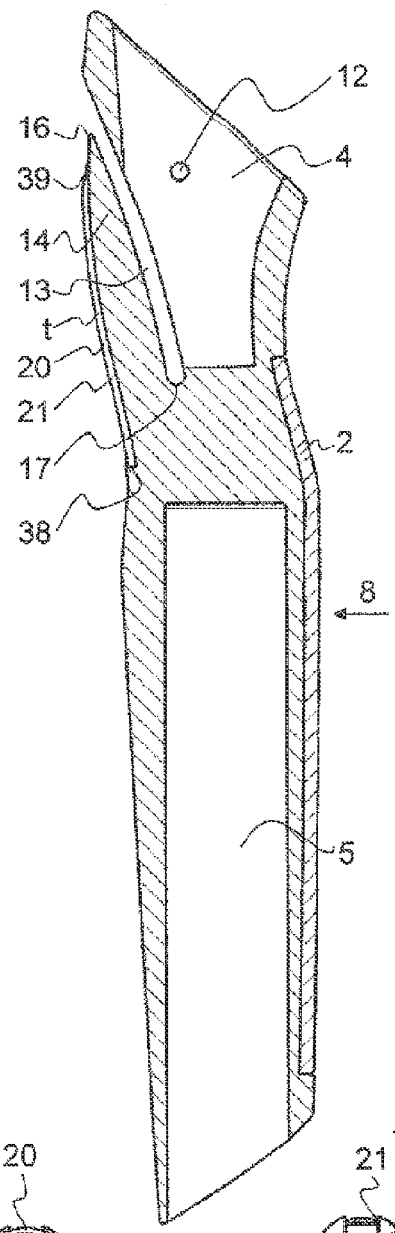
FIG. 9 shows a sectional view of the section according to A-A in FIG. 8.
Figure 10:
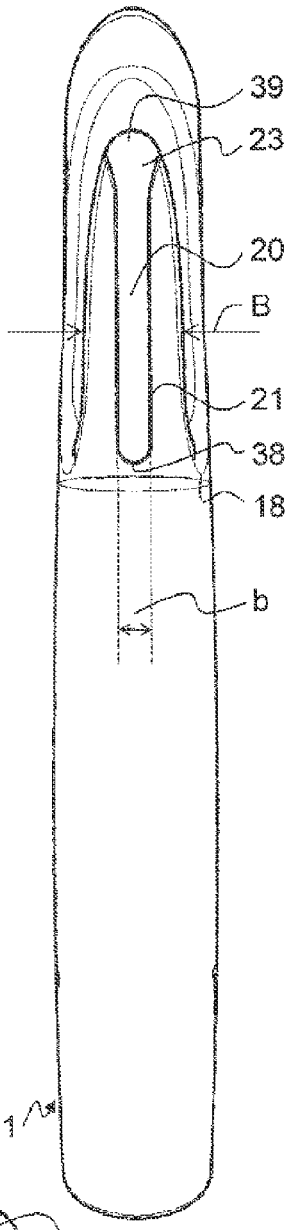
FIG. 10 shows a rear view of the second exemplary embodiment.
Figure 11:
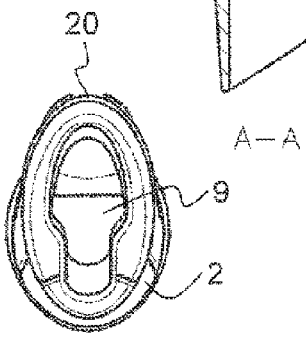
FIG. 11 shows a plan view from above of the grip of the second exemplary embodiment.
Figure 12:
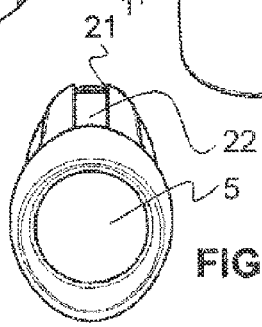
FIG. 12 shows a view from below of the second exemplary embodiment.

A second exemplary embodiment is shown in FIGS. 8-12. The same reference numbers here designate the same elements as within the framework of the exemplary embodiment in the previous figures. The exemplary embodiment is in this case, in particular in FIG. 9, given without the corresponding fixing block in a central sectional view so that in particular the depth t of the groove can be recognized. In this exemplary embodiment there is no recess 24 in the groove base for a guide pin but the groove has the same depth of the groove base over the entire axial length. In such a case it is either possible to completely dispense with the guide pin 27 in the construction of the hand-retaining device but it is also possible to configure the guide pin simply only with the same height as the rib 28. The guide pin then does not have to have a circular cross-section but can be configured to be elongated with rounding on the underside, in order to terminate optimally with the rounding in the region of the groove boundary 38.

Figure 13:
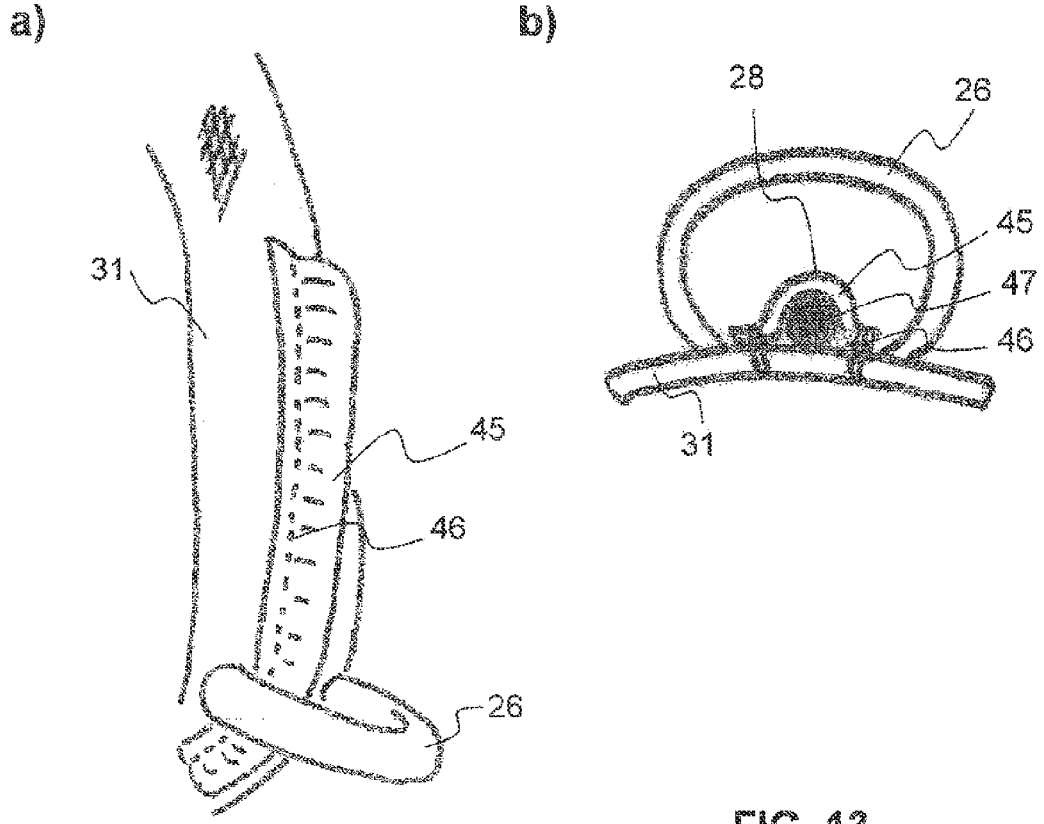
FIG. 13 shows a further exemplary embodiment of a hand loop with guide means in the eyelet region, wherein a) shows a perspective view of a section of the hand loop and b) shows a section perpendicular to the opening axis.

A further exemplary embodiment of a hand loop with a guide element is shown in FIG. 13 in two different sections: in a) in a perspective view only onto the region between forefinger and thumb and in b) in a sectional view perpendicular to the opening axis 43 in the region of the eyelet 26. In this exemplary embodiment there is a sewn-on patch of a textile material provided by the rib 28. The textile strip 45 is sewn onto one or more textile layers 31 of the hand loop in this region and extends as a strip from above the eyelet to somewhat below it. The textile strip 45 covers below it a likewise elongated shaped piece 47 disposed parallel to the longitudinal axis of the textile strip 45, made of a pressure-stable material, here a cord section made of a multifilament aramid material which however is preferably bendable about its longitudinal axis to a certain extent. This shaped piece 47 has the result that the elongated textile strip 45 curves towards the hand grip in the region of the shaped piece forming a rib 28. A cord section of a monofilament or multifilament material, for example, aramid such as Kevlar® or Dyneema® is suitable for this shaped piece. This shaped piece 47 is covered by the textile strip 45 and a circumferential seam 46 and/or adhesion encloses the shaped piece 47. Alternatively without a separate textile strip 45 in a multilayer arrangement of the hand loop in this region it is possible to arrange the shaped piece 47 between two of these layers and position parallel to the opening axis 43 in a suitable region.

REFERENCE LIST

1 Pole grip
2 Soft region at front
3 Grip body
4 Recess in 3
5 Cavity in 3 for pole tube
6 Fixing block
7 Hand side
8 Front side
9 Actuation button
10 Axis of rotation of 6
11 Retaining lug of 6
12 Bore in 3 for 10
13 Slot for loop
14 Retaining mandrel
15 Region for fastened loop/eyelet
16 Tip of 14
17 Saddle point
18 Lower transition region to outer surface
19 Rear surface of 14
20 Axial groove in 19
21 Flank of 20, wall of 20
22 Base of 20, groove base
23 Upper extension of 20
24 Recess in groove base
25 Hand loop
26 Loop
27 Guide pin
28 Guide rib
29 Region of 25 between thumb and hand surface
30 Plastic attachment
31 Textile layer
32 Insertion opening of 25
33 Opening of 25 for back of hand and finger
34 Opening of 25 for thumb
35 Adjusting mechanism of 25
36 Protective covering below 29
37 Elevations on 28
38 Groove boundary
39 Groove opening
40 Pendulum movement of hand loop upwards
41 Pendulum movement of pole grip frontwards
42 Longitudinal axis of 14
43 Opening axis of 26
44 Web

45 Textile layer of 28
46 Side seam of 45
47 Sewn-in shaped piece
B Width of 14
b Width of 20
t Depth of 20

The invention claimed is:

1. A pole grip comprising:

a grip body, a hook-shaped device for fastening a hand-retaining device, displaceable or twistable latching elements arranged in an area of the hook-shaped device in such a manner that a loop-shaped, ring-shaped or eyelet-shaped device inserted into the hook-shaped device substantially from above, which is provided on the hand-retaining device, is fixed in the hook-shaped device in a self-latching manner, and first anti-twisting elements provided on the hook-shaped device which prevent any twisting of the loop-shaped, ring-shaped or eyelet-shaped device fastened on the hook-shaped device about a longitudinal axis of the hook-shaped device;

wherein the first anti-twisting elements are configured in the form of a first groove in the hook-shaped device extending along the longitudinal axis or in the form of a first rib on the hook-shaped device extending along the longitudinal axis.

2. The pole grip according to claim 1, wherein the first anti-twisting elements are configured in the form of the first groove in the hook-shaped device extending along the longitudinal axis and wherein the first groove is provided in a rear surface of the hook-shaped device facing away from the grip body and extends from an upper-side tip, and wherein the first groove is configured to be open, downwards over an entire length of the hook-shaped device and is closed at a lower end by a groove boundary.

3. The pole grip according to claim 2, wherein the first groove over its length has a substantially constant width (b) transverse to the longitudinal axis of the hook-shaped device.

4. The pole grip according to claim 3, wherein the first groove over its length has a substantially constant width (b) transverse to the longitudinal axis of the hook-shaped device and at an upper end has a region which expands upwards.

5. The pole grip according to claim 1, wherein the first groove has a recess in a region of a groove boundary in a groove base.

6. The pole grip according to claim 1, wherein the first groove is configured as a U-shaped groove with flanks standing parallel to one another and groove base disposed perpendicular thereto.

7. The pole grip according to claim 1, wherein a width (b) of the groove is in the range of 0.1-0.75 times a width (B) of the hook-shaped device at half height of the hook-shaped device between a tip of the hook-shaped device and a region of the hook-shaped device for the loop-shaped, ring-shaped or eyelet-shaped device inserted in the hook-shaped device.

8. The pole grip according to claim 1, wherein a length of the hook-shaped device measured from a tip thereof facing a grip head as far as a region in which a the loop-shaped, ring-shaped or eyelet-shaped device inserted in the hook-shaped device is captured in a slot between the hook-shaped device and the grip head is in a range of 2-4.5 cm and/or wherein a width of the hook-shaped device lies in a range of 1-1.5 cm and tapers towards a tip over a length of 1.5-2 cm in rounded form, wherein a short axis except in a tip-side tapering region has a length in a range of 0.3-1.5 cm.

9. The hand-retaining device, for use with the pole grip according to claim 1, wherein in a region between thumb and forefinger, the loop-shaped, ring-shaped or eyelet-shaped device which is inherently flexible but nevertheless positionally stable in space is provided and second anti-twisting elements are provided substantially parallel to an opening axis of the device above and/or below the device, the second anti-twisting elements prevent any twisting of the loop-shaped, ring-shaped or eyelet-shaped device fastened on the hook-shaped device about the longitudinal axis of the hook-shaped device.

10. The hand-retaining device according to claim 9, wherein the second anti-twisting elements are configured in the form of a second groove extending along the opening axis in the hand-retaining device and/or in the form of a second rib extending along the opening axis and/or at least a projection disposed on the opening axis.

11. The hand-retaining device according to claim 10, wherein the second anti-twisting elements are configured in the form of the second rib extending along the opening axis on a region of the hand-retaining device facing the pole grip when the hand-retaining device is worn by a user and is attached to the pole grip and the pole grip is held by the user.

12. The hand-retaining device according to claim 10, wherein the second anti-twisting elements additionally comprise a guide pin, which guide pin is disposed below the device when the hand-retaining device is worn by a user and is attached to the pole grip and the pole grip is held by the user.

13. The hand-retaining device according to claim 9, wherein the second anti-twisting elements are only provided at a height of the device when the hand-retaining device is worn by a user and is attached to the pole grip and the pole grip is held by the user.

14. The hand-retaining device according to claim 10, wherein the second anti-twisting elements are configured in the form of the second rib extending along the opening axis on a region of the hand-retaining device facing the pole grip when used as prescribed, on a side disposed above the device when the hand-retaining device is worn by a user and is attached to the pole grip and the pole grip is held by the user, wherein the rib has a length in the range of 10-15 mm and a width in the range of 0.3-0.7 cm, wherein the second rib is formed from a thermoplastic material and with a substantially rectangular or square cross-sectional area or the second rib is formed by an elongated shaped piece extending along the opening axis, from a monofilament or multifilament piece of cord or from plastic or metal, having a round cross-section and a diameter in a range of 1-6 mm, including flat textile strip, wherein the textile strip is longer than the hook shaped piece and encloses the latter with a circumferential seam and/or weld.

15. The hand-retaining device according to claim 10, wherein the second anti-twisting elements additionally comprise a guide pin having a substantially circular cross-sectional area, which guide pin is disposed below the device when the hand-retaining device is worn by a user and is attached to the pole grip and the pole grip is held by the user, and which guide pin has a height which is greater than a height of the second rib.

16. The hand-retaining device according to claim 9, wherein no second anti-twisting elements are provided at a height of the hand-retaining device, but only above and below the height of the hand-retaining device when the hand-retaining device is worn by a user and is attached to the pole grip and the pole grip is held by the user.

17. A pole grip set comprising the pole grip according to claim 1 and the hand-retaining device wherein the first anti-twisting elements on the pole grip and second anti-twisting elements on the hand-retaining device are matched to one another in regard to dimensioning so they positively intermesh when the hand-retaining device is fastened on the pole grip.

18. The pole grip set according to claim 17, wherein the first and second anti-twisting elements are configured in such a manner that during a prescribed pivoting movement of the hand-retaining device about the pole grip they intermesh positively above the loop-shaped, ring-shaped or eyelet-shaped device in the hook-shaped device.

19. The hand-retaining device, in the form of a glove or a hand loop for use with the pole grip set according to claim 17, wherein in the region between thumb and forefinger, the loop-shaped, ring-shaped or eyelet-shaped device which is inherently flexible but nevertheless positionally stable in space is provided and the elements are provided substantially parallel to the opening axis of the device above and/or below the device, which elements prevent any twisting of the loop-shaped, ring-shaped or eyelet-shaped device fastened on the hook-shaped device about the longitudinal axis of the hook-shaped device.

20. The pole grip according to claim 1, for walking sticks, trekking poles, alpine ski poles, cross-country ski poles or Nordic walking poles comprising the grip body and comprising the hook-shaped device for fastening the hand-retaining device, in the form of a hand loop or a glove.

21. The pole grip according to claim 1, wherein the first anti-twisting elements are configured in the form of the first groove in the hook-shaped device extending along the longitudinal axis and wherein the first groove is provided in a rear surface of the hook-shaped device facing away from the grip body and extends from an upper-side tip, wherein the first groove is configured to be open, downwards over the entire length of the hook-shaped device and is closed at a lower end by a groove boundary, wherein this groove boundary is disposed in relation to a grip head below that region in which the loop-shaped, ring-shaped or eyelet-shaped device inserted into the hook-shaped device is captured in a slot between the hook-shaped device and the grip head.

22. The pole grip according to claim 1, wherein the first groove has a recess, in the form of a circular or polygonal blind hole, in a region of a groove boundary in a groove base.

23. The pole grip according to claim 1, wherein the first groove is configured as a U-shaped groove with flanks standing parallel to one another and groove base disposed perpendicular thereto, wherein a depth of the groove as far as the groove base is in a range of 0.75-1.5 mm.

24. The pole grip according to claim 1, wherein a width (b) of the first groove is in a range of 0.1-0.75 times a width (B) of the hook-shaped device at half height of the hook-shaped device between a tip of the hook-shaped device and a region of the hook-shaped device for the loop-shaped, ring-shaped or eyelet-shaped device inserted in the hook-shaped device, wherein the width (b) of the first groove corresponds to 0.25-0.5 times the width (B) of the hook-shaped device and wherein the width (b) lies in a range of 0.3-0.7 cm.

25. The pole grip according to claim 1, wherein a length of the hook-shaped device measured from a tip thereof facing a grip head as far as a region in which the loop-shaped, ring-shaped or eyelet-shaped device inserted in the hook-shaped device is captured in a slot between the hook-shaped device and the grip head is in a range of 3-4 cm and/or that a width (B) of the hook-shaped device lies in a range of 1-1.5 cm and tapers towards a tip over a length of 1.5-2 cm in rounded form, wherein a cross-sectional surface of the hook-shaped device is configured to be oval or lens-shaped with a long axis transverse to the pole grip and to a prescribed running direction, wherein a short axis except in a tip-side tapering region has a length in a range of 0.5-1 cm.

* * * * *